US008584767B2

(12) United States Patent
Johnson et al.

(10) Patent No.: US 8,584,767 B2
(45) **Date of Patent: *Nov. 19, 2013**

(54) SPRINKLER VALVE WITH ACTIVE ACTUATION

(75) Inventors: Alfred David Johnson, San Leandro, CA (US); Roger Graham Gilbertson, Novato, CA (US); Valery Martynov, San Francisco, CA (US)

(73) Assignee: TiNi Alloy Company, Berkeley, CA (US)

( * ) Notice: Subject to any disclaimer, the term of this patent is extended or adjusted under 35 U.S.C. 154(b) by 1129 days.

This patent is subject to a terminal disclaimer.

(21) Appl. No.: 12/503,614

(22) Filed: Jul. 15, 2009

(65) Prior Publication Data

US 2010/0006304 A1 Jan. 14, 2010

Related U.S. Application Data

(63) Continuation-in-part of application No. 12/019,553, filed on Jan. 24, 2008.

(60) Provisional application No. 60/897,708, filed on Jan. 25, 2007, provisional application No. 61/081,004, filed on Jul. 15, 2008.

(51) Int. Cl.
*A62C 2/00* (2006.01)

(52) U.S. Cl.
USPC ..... 169/43; 169/37; 169/38; 169/40; 169/41; 169/46; 169/90

(58) Field of Classification Search
USPC ..... 169/37–41, 43, 45–47, 90
See application file for complete search history.

(56) References Cited

U.S. PATENT DOCUMENTS

| | | | |
|---|---|---|---|
| 368,425 | A | 8/1887 | Ross et al. |
| 538,593 | A | 4/1895 | Naylor, Jr. |
| 1,560,335 | A | 11/1925 | Czochralski |
| 1,904,828 | A | 4/1933 | Green |
| 1,913,035 | A | 6/1933 | Loepsinger |
| 1,926,925 | A | 9/1933 | Wescott |
| 2,060,593 | A | 11/1936 | Schaurte et al. |
| 2,371,614 | A | 3/1945 | Graves |

(Continued)

FOREIGN PATENT DOCUMENTS

| | | |
|---|---|---|
| EP | 0053596 | 6/1982 |
| EP | 0310439 | 4/1989 |

(Continued)

OTHER PUBLICATIONS

Xiaogdang, Ma; U.S. Appl. No. 10/972,759 entitled "Magnetic data storage system," filed Oct. 25, 2004.

(Continued)

*Primary Examiner* — Steven J Ganey
(74) *Attorney, Agent, or Firm* — Shay Glenn LLP

(57) ABSTRACT

A temperature-activated valve for a conventional fire sprinkler utilizing a hyperelastic single-crystal shape memory alloy is described. The shape-memory element expands as it is heated, forcing a bolt to break, thereby opening the sprinkler valve. The shape memory element typically communicates with the valve so as to force it open. The devices described are less susceptible to accidental breakage than conventional actuators, and have fewer moving parts. Transition temperature of the shape memory alloy can be tuned to a narrow range.

8 Claims, 12 Drawing Sheets

(56) References Cited

U.S. PATENT DOCUMENTS 2,586,556 A 2/1952 Mullikin
2,608,996 A 9/1952 Forman
2,610,300 A 9/1952 Walton et al.
2,647,017 A 7/1953 Coulliette
2,793,036 A 5/1957 Hansburg
2,911,504 A 11/1959 Cohn
3,229,956 A 1/1966 White
3,351,463 A 11/1967 Rozner et al.
3,357,432 A 12/1967 Sparks
3,400,906 A 9/1968 Stocklin
3,408,890 A 11/1968 Bochman, Jr.
3,435,823 A 4/1969 Edwards
3,445,086 A 5/1969 Quinn
3,454,286 A 7/1969 Anderson et al.
3,546,996 A 12/1970 Grijalva et al.
3,559,641 A 2/1971 Lay
3,561,537 A 2/1971 Dix et al.
3,613,732 A 10/1971 Willson et al.
3,620,212 A 11/1971 Fannon, Jr. et al.
3,659,625 A 5/1972 Coiner et al.
3,668,131 A 6/1972 Banush et al.
3,725,835 A 4/1973 Hopkins et al.
3,789,838 A 2/1974 Fournier et al.
3,849,756 A 11/1974 Hickling
3,888,975 A 6/1975 Ramwell
3,913,572 A 10/1975 Wheeler
3,918,443 A 11/1975 Vennard et al.
3,974,844 A 8/1976 Pimentel
3,991,898 A 11/1976 Hanson et al.
4,055,955 A 11/1977 Johnson
4,063,831 A 12/1977 Meuret
4,072,159 A 2/1978 Kurosawa
4,096,993 A 6/1978 Behr
4,145,764 A 3/1979 Kuzuki et al.
4,151,064 A 4/1979 Kuehnle
4,176,719 A 12/1979 Bray
4,177,327 A 12/1979 Mathews
4,243,963 A 1/1981 Jameel et al.
4,265,684 A 5/1981 Boll
4,279,190 A 7/1981 Hummel
4,279,790 A 7/1981 Nakajima
4,340,049 A 7/1982 Munsch
4,434,855 A 3/1984 Given, Jr. et al.
4,485,545 A 12/1984 Caverly
4,501,058 A 2/1985 Schutzler
4,524,343 A 6/1985 Morgan et al.
4,549,717 A 10/1985 Dewaegheneire
4,551,974 A 11/1985 Yaeger et al.
4,553,393 A 11/1985 Ruoff
4,553,602 A * 11/1985 Pieczykolan ..... 169/90
4,558,715 A 12/1985 Walton et al.
4,567,549 A 1/1986 Lemme
4,585,209 A 4/1986 Aine et al.
4,589,179 A 5/1986 Hulting, Jr.
4,596,483 A 6/1986 Gabriel et al.
4,619,284 A 10/1986 Delarue et al.
4,654,191 A 3/1987 Krieg
4,684,913 A 8/1987 Yaeger
4,706,758 A 11/1987 Johnson
4,753,465 A 6/1988 Dalby
4,821,997 A 4/1989 Zdeblick
4,823,607 A 4/1989 Howe et al.
4,824,073 A 4/1989 Zdeblick
4,848,388 A 7/1989 Waldbusser
4,854,797 A 8/1989 Gourd
4,864,824 A 9/1989 Gabriel et al.
4,893,655 A 1/1990 Anderson
4,896,728 A 1/1990 Wolff et al.
4,915,773 A 4/1990 Kravetsky
4,943,032 A 7/1990 Zdeblick
5,044,947 A 9/1991 Sachdeva et al.
5,060,888 A 10/1991 Vezain et al.
5,061,137 A 10/1991 Gourd
5,061,914 A 10/1991 Busch et al.
5,069,419 A 12/1991 Jerman
5,072,288 A 12/1991 MacDonald et al.
5,102,276 A 4/1992 Gourd
5,114,504 A 5/1992 AbuJudom, II et al.
5,116,252 A 5/1992 Hartman
5,117,916 A 6/1992 Ohta et al.
5,119,555 A 6/1992 Johnson
5,129,753 A 7/1992 Wesley et al.
5,131,843 A 7/1992 Hilgers et al.
5,160,233 A 11/1992 McKinnis
5,190,546 A 3/1993 Jervis
5,192,147 A 3/1993 McCloskey
5,211,371 A 5/1993 Coffee
5,218,998 A 6/1993 Bakken et al.
5,245,738 A 9/1993 Johnson
5,309,717 A 5/1994 Minch
5,312,152 A 5/1994 Woebkenberg, Jr. et al.
5,312,247 A 5/1994 Sachdeva et al.
5,325,880 A 7/1994 Johnson et al.
5,344,117 A 9/1994 Trah et al.
5,364,046 A 11/1994 Dobbs et al.
5,395,238 A 3/1995 Andreiko et al.
5,447,432 A 9/1995 Andreiko et al.
5,456,600 A 10/1995 Andreiko et al.
5,474,448 A 12/1995 Andreiko et al.
5,474,563 A 12/1995 Myler et al.
5,494,113 A 2/1996 Polan
5,502,982 A 4/1996 Venetucci
5,543,349 A 8/1996 Kurtz et al.
5,605,543 A 2/1997 Swanson
5,619,177 A 4/1997 Johnson et al.
5,622,225 A 4/1997 Sundholm
5,640,217 A 6/1997 Hautcoeur et al.
5,641,364 A 6/1997 Golberg et al.
5,645,423 A 7/1997 Collins, Jr.
5,658,515 A 8/1997 Lee et al.
5,676,356 A 10/1997 Ekonen et al.
5,683,245 A 11/1997 Sachdeva et al.
5,695,504 A 12/1997 Gifford, III et al.
5,714,690 A 2/1998 Burns et al.
5,722,989 A 3/1998 Fitch et al.
5,771,742 A 6/1998 Bokaie et al.
5,772,378 A 6/1998 Keto-Tokoi
5,772,864 A 6/1998 Moller et al.
5,796,152 A 8/1998 Carr et al.
5,819,749 A 10/1998 Lee et al.
5,825,275 A 10/1998 Wuttig et al.
5,837,394 A 11/1998 Schumm, Jr.
5,840,199 A 11/1998 Warren
5,850,837 A 12/1998 Shiroyama et al.
5,867,302 A 2/1999 Fleming
5,903,099 A 5/1999 Johnson et al.
5,916,178 A 6/1999 Noone et al.
5,924,492 A 7/1999 Kikuchi et al.
5,930,651 A 7/1999 Terasawa
5,960,812 A 10/1999 Johnson
6,013,854 A 1/2000 Moriuchi
6,042,374 A 3/2000 Farzin-Nia et al.
6,042,553 A 3/2000 Solar et al.
6,072,617 A 6/2000 Henck
6,073,700 A 6/2000 Tsuji et al.
6,075,239 A 6/2000 Aksyuk et al.
6,080,160 A 6/2000 Chen et al.
6,084,849 A 7/2000 Durig et al.
6,096,175 A 8/2000 Roth
6,101,164 A 8/2000 Kado et al.
6,107,004 A 8/2000 Donadio, III
6,110,204 A 8/2000 Lazarov et al.
6,123,153 A 9/2000 Finnegan
6,124,523 A 9/2000 Banas et al.
6,126,371 A 10/2000 McCloskey
6,129,153 A 10/2000 Joung
6,139,143 A 10/2000 Brune et al.
6,169,269 B1 1/2001 Maynard
6,195,478 B1 2/2001 Fouquet
6,203,715 B1 3/2001 Kim et al.
6,224,626 B1 5/2001 Steinke
6,229,640 B1 5/2001 Zhang
6,247,493 B1 6/2001 Henderson
6,277,133 B1 8/2001 Kanesaka

(56) References Cited

U.S. PATENT DOCUMENTS

| | | | |
|---|---|---|---|
| 6,284,067 | B1 | 9/2001 | Schwartz et al. |
| 6,352,494 | B2 | 3/2002 | McAlonan |
| 6,358,380 | B1 | 3/2002 | Mann et al. |
| 6,379,383 | B1 | 4/2002 | Palmaz et al. |
| 6,386,507 | B2 | 5/2002 | Dhuler et al. |
| 6,406,605 | B1 | 6/2002 | Moles |
| 6,407,478 | B1 | 6/2002 | Wood et al. |
| 6,410,360 | B1 | 6/2002 | Steenberge |
| 6,447,478 | B1 | 9/2002 | Maynard |
| 6,451,668 | B1 | 9/2002 | Neumeier et al. |
| 6,454,913 | B1 | 9/2002 | Rasmussen et al. |
| 6,470,108 | B1 | 10/2002 | Johnson |
| 6,475,261 | B1 | 11/2002 | Matsumoto et al. |
| 6,524,322 | B1 | 2/2003 | Berreklouw |
| 6,533,905 | B2 | 3/2003 | Johnson et al. |
| 6,537,310 | B1 | 3/2003 | Palmaz et al. |
| 6,582,985 | B2 | 6/2003 | Cabuz et al. |
| 6,592,724 | B1 | 7/2003 | Rasmussen et al. |
| 6,596,102 | B2 | 7/2003 | Homma |
| 6,605,111 | B2 | 8/2003 | Bose et al. |
| 6,614,570 | B2 | 9/2003 | Johnson et al. |
| 6,620,634 | B2 | 9/2003 | Johnson et al. |
| 6,624,730 | B2 | 9/2003 | Johnson et al. |
| 6,669,794 | B1 | 12/2003 | Bellouard et al. |
| 6,669,795 | B2 | 12/2003 | Johnson et al. |
| 6,672,502 | B1 | 1/2004 | Paul et al. |
| 6,688,828 | B1 | 2/2004 | Post |
| 6,729,599 | B2 | 5/2004 | Johnson |
| 6,742,761 | B2 | 6/2004 | Johnson et al. |
| 6,746,890 | B2 | 6/2004 | Gupta et al. |
| 6,771,445 | B1 | 8/2004 | Hamann et al. |
| 6,790,298 | B2 | 9/2004 | Johnson et al. |
| 6,805,898 | B1 | 10/2004 | Wu et al. |
| 6,811,910 | B2 | 11/2004 | Tsai et al. |
| 6,840,329 | B2 | 1/2005 | Kikuchi et al. |
| 6,843,465 | B1 | 1/2005 | Scott |
| 6,849,085 | B2 | 2/2005 | Marton |
| 6,852,132 | B1 | 2/2005 | Houser et al. |
| 6,908,275 | B2 | 6/2005 | Nelson et al. |
| 6,918,545 | B2 | 7/2005 | Franson et al. |
| 6,920,966 | B2 | 7/2005 | Buchele et al. |
| 6,955,187 | B1 | 10/2005 | Johnson |
| 7,022,173 | B2 | 4/2006 | Cummings et al. |
| 7,040,323 | B1 | 5/2006 | Menchaca et al. |
| 7,044,596 | B2 | 5/2006 | Park |
| 7,073,504 | B2 | 7/2006 | Callister et al. |
| 7,084,726 | B2 | 8/2006 | Gupta et al. |
| 7,201,367 | B2 | 4/2007 | Wietharn |
| 7,422,403 | B1 | 9/2008 | Johnson et al. |
| 7,441,888 | B1 | 10/2008 | Johnson |
| 7,524,914 | B2 | 4/2009 | Mather et al. |
| 7,540,899 | B1 | 6/2009 | Johnson |
| 7,736,687 | B2 | 6/2010 | Sims et al. |
| 7,793,911 | B2 | 9/2010 | Fontana et al. |
| 2001/0023010 | A1 | 9/2001 | Yamada et al. |
| 2002/0018325 | A1 | 2/2002 | Nakatani et al. |
| 2002/0062154 | A1 | 5/2002 | Ayers |
| 2002/0106614 | A1 | 8/2002 | Prince et al. |
| 2002/0192617 | A1 | 12/2002 | Phan et al. |
| 2003/0002994 | A1 | 1/2003 | Johnson et al. |
| 2003/0078465 | A1 | 4/2003 | Pai et al. |
| 2003/0170130 | A1 | 9/2003 | Johnson |
| 2004/0083006 | A1 | 4/2004 | Ellingsen |
| 2004/0200551 | A1 | 10/2004 | Brhel et al. |
| 2004/0221614 | A1 | 11/2004 | Holemans et al. |
| 2004/0243219 | A1 | 12/2004 | Fischer et al. |
| 2004/0249399 | A1 | 12/2004 | Cinquin et al. |
| 2005/0113933 | A1 | 5/2005 | Carter et al. |
| 2006/0118210 | A1 | 6/2006 | Johnson |
| 2006/0204738 | A1 | 9/2006 | Dubrow et al. |
| 2006/0213522 | A1 | 9/2006 | Menchaca et al. |
| 2006/0232374 | A1 | 10/2006 | Johnson |
| 2006/0240953 | A1 | 10/2006 | Shahinpoor |
| 2007/0137740 | A1 | 6/2007 | Johnson et al. |
| 2007/0173787 | A1 | 7/2007 | Huang et al. |
| 2007/0207321 | A1 | 9/2007 | Abe et al. |
| 2007/0246233 | A1 | 10/2007 | Johnson |
| 2008/0075557 | A1 | 3/2008 | Johnson et al. |
| 2008/0213062 | A1 | 9/2008 | Johnson |
| 2009/0035859 | A1 | 2/2009 | Johnson |
| 2009/0095493 | A1 | 4/2009 | Johnson et al. |
| 2009/0139613 | A1 | 6/2009 | Johnson et al. |
| 2009/0171294 | A1 | 7/2009 | Johnson et al. |
| 2009/0183986 | A1 | 7/2009 | Johnson et al. |
| 2009/0187243 | A1 | 7/2009 | Johnson |
| 2010/0129766 | A1 | 5/2010 | Hilgers |
| 2010/0190127 | A1 | 7/2010 | Ghantiwala et al. |
| 2011/0253525 | A1 | 10/2011 | Johnson |
| 2011/0299915 | A1 | 12/2011 | Crane et al. |
| 2011/0313513 | A1 | 12/2011 | Johnson |
| 2012/0048432 | A1 | 3/2012 | Johnson et al. |

FOREIGN PATENT DOCUMENTS

| | | | |
|---|---|---|---|
| EP | 0836839 | A2 | 4/1998 |
| EP | 1122526 | | 8/2001 |
| EP | 1238600 | | 9/2002 |
| EP | 1779817 | A1 | 5/2007 |
| GB | 2187951 | | 9/1987 |
| JP | 48071713 | A | 9/1973 |
| JP | 57161031 | | 10/1982 |
| JP | 58088200 | A | 5/1983 |
| JP | 59179771 | | 10/1984 |
| JP | 07090624 | | 4/1995 |
| JP | 10173306 | | 6/1998 |
| JP | 2000185999 | A | 7/2000 |
| SU | 1434314 | | 10/1988 |
| WO | WO98/42277 | A1 | 10/1998 |
| WO | WO98/53362 | | 11/1998 |
| WO | WO99/16387 | A1 | 4/1999 |
| WO | WO99/62432 | | 12/1999 |
| WO | WO00/04204 | | 1/2000 |
| WO | WO03/052150 | | 6/2003 |
| WO | WO2005/108635 | | 11/2005 |
| WO | WO2006/019943 | | 2/2006 |

OTHER PUBLICATIONS

Johnson, David et al.; U.S. Appl. No. 11/006,501 entitled "Anastomosis device and method," filed Dec. 6, 2004.

Johnson, David et al.; U.S. Appl. No. 11/948,852 entitled "Method of alloying reactive elemental components;" filed Nov. 30, 2007.

Antonov et al.; New advances and developments in the Stepnakov method for the growth of shaped crystals; Crystallography Reports; vol. 47; Suppl. 1; 2002; pp. S43-S52.

Brice et al.; Crystal Growth; Ullmann's Encyclopedia of Industrial Chemistry; 2007; Wiley-VCH Verlag GmBH; pp. 1, 29-42, 50.

Buchaillot et al., "Thin film of titanium/nickel shape memory alloy for multi-degree of freedom microactuators", Seisan Kenkyu, vol. 51, No. 8, 1999, pp. 22-23.

Creuziger et al.; Initial transformation around a notch tip in CuA1Ni: experiment and modeling; Acta Materialia; vol. 56; pp. 518-526; 2008.

Dario et al.; Shape memory alloy microactuators for minimal invasive surgery; Proceedings of SMST-94 Conference; pp. 427-433; Pacific Grove CA; 1994.

ElastametTM brochure from New Discovery Metals; 2007.

ElastametTM website screen capture, accessed Jul. 23, 2008.

Fu et al.; The growth characteristics with a shape memory effect; J. Phys.: Condens. Matter; vol. 4; 1992; pp. 8303-8310.

http://www.algor.com/news_pub/tech_reports/2005/rubber &foam/default.asp.

Johnson et al., "Application of shape memory alloys: advantages, disadvantages, and limitations," Micromachining and Microfabrication Process Technology VII, 22-4, Oct. 2001, San Francisco, CA, USA, vol. 4557, pp. 341-351.

Johnson, A. D.; Vacuum-deposited TiNi shape memory film: Characterization and applications in microdevices; J. Micromech. Microeng.; vol. 1; pp. 34-41; 1991.

Krulevitch et al.; Thin film shape memory alloy microactuators; J. Micromech. Microeng.; vol. 5; No. 4; 26 pgs.; 1996.

(56) References Cited

OTHER PUBLICATIONS

Martynov, V., "TiNi thin films for microactuators and microdevices: sputter deposition and processing techniques", Thermec' 2003, Internat'l Conf. on Processing and Manufacturing of Advanced Materials, Jul. 7-11, 2003, Leganes, Madrid, Spain, Materials Science Forum, Jul. 7, 2003 vol. 426-432; pp. 3475-3480.
Morgan; Medical shape memory alloy applications—The market and its products; Materials Science and engineering A 378; 2004; pp. 16-23.
Pauling, Linus, College Chemistry, second edition, W.H. Freeman and Company, San Francisco, 1955, pp. 81-91.
Qingfu et al.; Stabilisation of martensite during training of Cu-Al-Ni single crystals; Journal de Physique IV; Collloqu C2; Supplement to the Journa de Physique III; vol. 5; Feb. 1995; pp. 181-186.
Recarte et al.; Influence of Al and Ni concentration on the martensitic transformation in Cu-Al-Ni shape-memory alloys; Metallurgical and MaterialsTransactions A; vol. 33A; Aug. 2002; pp. 2581-2591.
Schetky, L.M.; Shape-memory alloys; Scientific American, pp. 74-82; 1979.
Sittner et al.; Stress induced martensitic transformations in tension/torsion of CuAlNi single crystal tube; Scripta Materialia; vol. 48; 2003; pp. 1153-1159.
Sutuo et al.; Development of medical guide wire of Cu-Al-Mn-base superelastic alloy with functionally graded characteristics; Mater Res Part B: Appl Biomater; vol. 69B; 2004; pp. 64-69.
Takabayashi et al., "Reversible shape memory alloy film fabricated by RF sputtering", Materials and Manufacturing Processes, vol. 13, No. 2, 1998, pp. 275-286.
Viahhi et al.; "Robototechnic Constructions Based on CU-AL-NI Single Crystal Actuators;" Proceedings of Second International Conference on Shape Memory and Superelastic Technologies; 1997; United States.
Wang et al.; Temperature memory effect in CuAlNi single crystalline and CUZnAl polycrystalline shape memory alloys; Thermochimica Acta; vol. 448; 2006; pp. 69-72.
Yahia et al.; Bioperformance of shape memory alloy single crystals; Bio-Medical Materials and Engineering; vol. 16; 2006; pp. 101-118.
Zhang et al.; Nanoscale pseudoelasticity of single-crystal Cu-Al-Ni shape-memory alloy induced by cyclic nanoindentation; J Mater Sci; vol. 41; 2006; pp. 5021-5024.
Zhang et al.; The variant selection criteria in single-crystal CuAlNi shape memory alloys; Smart Mater. Struct.; vol. 9; 2000; pp. 571-581.
Zhdanov et al.; Thermal stresses in tubes, produced from a melt by the Stepanov method, during their cooling; Journal of Engineering Physics and Thermophysics; vol. 68; No. 1; 1995; pp. 80-89.
Johnson, Alfred David; U.S. Appl. No. 13/601,749 entitled "Fire Sprinkler Valve Actuator," filed Aug. 31, 2012.
Johnson, A. David; U.S. Appl. No. 12/952,002 entitled "Hyperelastic shape setting devices and fabrication methods," filed Nov. 22, 2010.
Christian et al.; The application of shape memory actuators in anthropomorphic upper limb prostheses; Artif. Organs; vol. 27; No. 5; pp. 473-477; 2003.
Gill et al.; Three-Dimensional Thin-Film Shape Memory Alloy Microactuator With Two-Way Effect; Journal of Microelectromechanical Sys.; vol. 11; No. 1; Feb. 2002; pp. 68-77.

* cited by examiner

| | |
|---|---|
| Af measured with the fixture was: | -40C |
| Plateau stress: | 295 MPa |
| Pulled to: | 400 MPa |

| | |
|---|---|
| Af measured with the fixture was: | +15 C |
| Plateau stress: | 157 MPa |
| Pulled to: | 400 MPa |

Stainless steel 4-40 screws DJ notched to 0.050" min diameter
(Max load 996 N)

DETAIL A
SCALE 10 : 1

$$F_{water} \times L_{water} = F_{bolt} \times L_{bolt}$$

$$L_{water} : L_{bolt} \approx 1 : 8$$

$$F_{water} : F_{bolt} \approx 8 : 1$$

SPRINKLER VALVE WITH ACTIVE ACTUATION

CROSS REFERENCE TO RELATED APPLICATIONS

This application claims priority to U.S. Provisional Patent Application Ser. No. 61/081,004, titled "SPRINKLER VALVE WITH ACTIVE ACTUATION", filed on Jul. 15, 2008. This application also claims priority as a Continuation-in-Part of U.S. patent application Ser. No. 12/019,553, titled "FRANGIBLE SHAPE MEMORY ALLOY FIRE SPRINKLER VALVE ACTUATOR", filed on Jan. 24, 2008, which claims priority of U.S. Provisional Patent Application Ser. No. 60/897,708, titled "SHAPE MEMORY ALLOY FIRE SPRINKLER VALVE ACTUATOR", filed on Jan. 25, 2007, all of which are herein incorporated by reference in their entirety.

This application may be related to U.S. patent application Ser. No. 11/731,508, titled "THERMAL ACTUATOR FOR FIRE PROTECTION SPRINKLER HEAD", filed on Mar. 29, 2007.

INCORPORATION BY REFERENCE

All publications, patents, and patent applications mentioned in this specification are herein incorporated by reference in their entirety as if each individual publication or patent application was specifically and individually indicated to be incorporated by reference in its entirety.

BACKGROUND OF THE INVENTION

The present invention relates to fire safety devices, and more particularly to thermally actuated sprinklers commonly used in commercial and residential buildings.

Large numbers of thermally-actuated fire sprinklers are installed in structures every year. These sprinklers, generally installed in the structure's ceiling, are connected to a pressurized water supply and are intended to release the water into the room when the temperature in the room indicates that a fire or conflagration is taking place.

Multiple techniques have been used to actuate prior art fire sprinkler heads. Some prior art sprinkler valves bond two components together with alloys that melt at low temperatures. When heated above the melting temperature of the eutectic alloy, the bond between the two components is released, and a control valve is permitted to open. This type of actuator is subject to failure as the solder ages and crystallizes, thereby weakening the bond.

A second type of prior art sprinkler valve uses a sealed glass tube nearly filled with a liquid that boils at a low temperature. As ambient temperature increases, the liquid boils, thereby raising the pressure inside the tube. At a high enough temperature the tube ruptures, permitting the sprinkler valve to open. Premature failure may occur, however, if the sprinkler head is subjected to mechanical shock and the tube is cracked.

Yet other prior art sprinkler valves incorporate shape memory components that change shape when a transition temperature is reached to actuate the sprinkler valve. Some such thermally actuated valves are described in U.S. Pat. No. 4,176,719; U.S. Pat. No. 4,549,717; U.S. Pat. No. 4,596,483; U.S. Pat. No. 4,706,758; U.S. Pat. No. 4,848,388; U.S. Pat. No. 4,896,728; U.S. Pat. No. 5,117,916; U.S. Pat. No. 5,494,113; U.S. Pat. No. 5,622,225; U.S. Pat. No. 5,924,492; U.S. Pat. No. 6,073,700; U.S. Pat. No. 6,840,329; and U.S. Pat. No. 6,843,465. However, these devices do not typically control the transition temperature of the shape memory alloy, and the valve structures may therefore be less reliable and overly complex.

False triggering of sprinkler heads can cause damage that is expensive to repair and contributes to the cost of fire insurance. Thermally-actuated fire safety devices must meet strict codes.

A common failure mode for fire sprinklers is the failure of the valve to open even after the trigger mechanism has removed the detent that holds the valve poppet in place. This may result from low pressure in the fluid supply line, corrosion of one or more of the parts that form the seal, or deterioration of the seal, such that the force from the fluid supply line is too small to move the poppet and open the flow path. Conventional fire sprinkler valve release mechanisms cannot be used to force open the valve, since they do not have the excess stroke and force necessary. Furthermore, shape memory alloy actuator mechanisms previously described are typically not designed to force the valve open. The majority of these designs rely on fluid pressure to move the poppet and allow flow.

Described herein are thermally-activated, frangible sprinkler valves including a shape-memory element that may meet these codes and address many of the problems identified above.

SUMMARY OF THE INVENTION

Described herein are thermally-activated valves and methods of making and using them. The thermally-activated valves described herein are particularly useful as part of a sprinkler head, though they may be used as part of any appropriate thermally-activated valve.

In general, these thermally-activated sprinkler valve assemblies include: a temperature-sensitive actuator having a frangible bolt coupled to a shape-memory element, and a fluid passageway with a valved outlet. The temperature-sensitive actuator activates the sprinkler valve when the temperature of the shape-memory element reaches or exceeds the pre-determined temperature. A portion of the temperature-sensitive actuator is linked to the poppet of the sprinkler valve, so that the temperature-sensitive actuator actively moves the poppet from the valve with some force, opening the valve even if the poppet is otherwise stuck or jammed. For example, the poppet may be positioned in communication with the actuator of the temperature-sensitive actuator.

For example, described herein are thermally-activated sprinkler valve assembly including a fluid passageway having an outlet (configured to connect to a source of pressurized fluid), a valve over the outlet, where the valve includes a poppet that is configured to releasably oppose the force of the pressurized fluid, and a temperature-sensitive actuator coupled to the valve. The temperature-sensitive actuator includes a frangible bolt and a shape-memory element capable of elongating at a pre-determined stress and temperature, wherein the frangible bolt applies compressive force to the shape-memory element. The temperature-sensitive actuator is configured to actuate the valve by breaking the frangible bolt when the temperature of the shape-memory element reaches or exceeds the pre-determined temperature. Furthermore, the actuator is configured to exert pressure on the poppet to actively open the valve poppet.

Any of the valve assemblies described herein may include a linkage that connects to the valve. For example, the temperature-sensitive actuator may be coupled to the valve through a linkage that is configured to oppose the force of pressurized fluid and thereby maintain the valve closed. The temperature-sensitive actuator may be positioned in parallel with the linkage.

Any appropriate linkage may be used. In general, a linkage links the actuator with the valve, and can be removed or displaced by the activation of the actuator. For example, a linkage may be a linkage bracket, a strut, or the like. In one variation, the linkage is a linkage bracket formed from two generally "T-shaped" brackets. The two linkages may connect to each other and to the valve along one axis (the top of the "T" shape); the actuator may be connected off-axis, between the bases of the "T" shape.

The temperature-sensitive actuator may be configured so that force from the pressurized fluid is not substantially transmitted to the shape-memory element. Transferring force from the fluid pressure to the shape-memory element may affect the strain profile of the shape-memory element, and alter the actuation temperature.

The plateau stress of the shape-memory element may be matched to the ultimate tensile strength of the frangible bolt. For example, the ultimate tensile strength of the frangible bolt (at which the bolt will break) may be approximately equal to the plateau stress of the shape-memory element. Matching the plateau stress and the ultimate tensile strength in this way may help insure that the actuator acts in a predictable fashion at a predetermined temperature.

The frangible bolt may be coupled or secured to the shape memory device by a nut or other securing means. For example, the bolt may be an elongate bolt that passes through a cylindrical shape-memory element. The bolt may be secured against either end of the shape-memory element with a flange and/or bolt, placing compressive stress on the shape-memory element.

A valve assembly may also include a frame portion extending from the fluid passageway. For example, a valve assembly may include one or more arms that extend from the fluid passageway. The frame portion may provide support for other valve assembly components, such as the linkage.

The frangible bolt may be modified by including one or more notches or the like. The frangible bolt may be notched to set or determine the ultimate tensile strength of the bolt. A notch may be an annular notch or a side-notch (e.g., a notch on only one or more sides of the bolt). The notch is typically a small region (compared to the overall length of the bolt) that has a narrower diameter. A frangible bolt is typically an elongate shape, and may be cylindrical (e.g., columnar). Other elongate shapes may also be used. Commercially available bolts may also be used. For example, a titanium bolt (e.g., a Ti6Al4V bolt). Other bolts may also be used, including steel (stainless steel) or the like. The bolt may be threaded. For example, the bolt may be threaded at one or both ends, or along the entire length). The bolt may have a head (e.g., a flange) or may be used with washers and one or more nuts.

The shape-memory element may be made of any appropriate shape memory alloy. Shape-memory alloys capable of elongating up to 7%, 8% or 9% of their length are particularly useful in these actuators. In particular, the shape-memory element may be a single-crystal CuAlNi alloy or a single-crystal CuAlMn alloy. Shape-memory alloys capable of elongating greater than 7% (such as single-crystal SMAs) typically have a stress plateau that is longer than other (non single-crystal SMAs). This elongated stress plateau means that the actuator has a higher tolerance for breaking the frangible bolt and thereby actuating. In turn, this higher tolerance translates into a higher tolerance for the shape, type, orientation and compressive pressure applied by the frangible bolt component of the actuator.

The shape-memory element may be a tempered single-crystal shape memory alloy. Tempering (e.g., heat treating to precipitate Al from the single-crystal shape memory alloy) may be used to set the stress profile, including the temperature at which the actuator will actuate.

The shape-memory element may be any appropriate shape for coupling to the frangible bolt so that it can rupture (break) the bolt when actuation occurs. For example, the shape-memory element may be a cylinder at least partially surrounding the frangible bolt. The cylinder may have any appropriate cross-section (e.g., circular, elliptical, square, etc.). The shape-memory element may be a strut or partial tube (e.g., a half-cylinder, etc.).

Also described herein are thermally-activated sprinkler valve assemblies including a fluid passageway having a valved outlet and configured to connect to a source of pressurized fluid, a linkage coupled to the valved outlet and configured to oppose the force of pressurized fluid and thereby maintain the valve closed, and a temperature-sensitive actuator coupled to the linkage, wherein the temperature-sensitive actuator includes a frangible bolt, and a shape-memory element capable of elongating as much as eight percent at a pre-determined stress and temperature. The frangible bolt applies compressive force to the shape-memory element. Any of the features described above may also be included as part of this sprinkler valve assembly. In general, the poppet (cover) of the valved outlet may be in communication with the shape-memory element capable of elongating, so that the shape-memory element is configured to apply pressure to the poppet to open the valve, in addition to breaking the frangible bolt.

Also described herein are thermally-activated sprinkler valve assemblies including a fluid passageway having a valved outlet and configured to connect to a source of pressurized fluid, a linkage bracket coupled to the valved outlet and configured to oppose the force of pressurized fluid and thereby maintain the valve closed, and a temperature-sensitive actuator coupled to the linkage bracket. The temperature-sensitive actuator includes a frangible bolt and a shape-memory element capable of elongating as much as eight percent at a pre-determined stress and temperature, wherein a length of the frangible bolt applies compressive force to the shape-memory element, and further wherein the plateau stress of the shape-memory element is approximately the same as the ultimate tensile strength of the bolt. The shape-memory element is configured to be placed in communication with a poppet (cover) on the valved outlet of the sprinkler, so that extension of the shape-memory element applies an opening force to the poppet.

Also described herein are methods of making a thermally-activated sprinkler valve assembly including the steps of: tuning a shape-memory element comprising single-crystal shape memory alloy to exert a pre-determined force at a predetermined temperature; forming a temperature-sensitive actuator by coupling a frangible bolt to the shape-memory element so that the shape-memory element is compressed; and coupling the actuator to a linkage, wherein the linkage is configured to couple with the valve of a fluid passageway having a valved outlet to oppose fluid pressure and maintain the valve closed, further wherein the shape-memory element communicates with the valve to apply force to open the valve when the shape-memory element is activated by the pre-determined temperature.

The step of tuning may include tempering the shape-memory alloy by a heat treatment process that causes controlled partial precipitation of Al.

The method may also include the step of coupling the linkage to the valve of the fluid passageway. For example, the step of coupling the actuator to the linkage may comprise coupling the actuator between two brackets forming the linkage.

The method may also include the step of matching the plateau stress of the shape-memory element to the ultimate tensile strength of the bolt.

The method may also include the step of connecting the shape-memory element to a valve poppet.

The method may also include the step of connecting the fluid passageway to a fluid source. This step may also be used as part of a method for installing a frangible, temperature-sensitive shape memory actuator for a sprinkler valve.

DETAILED DESCRIPTION OF THE INVENTION

Figure 1A:
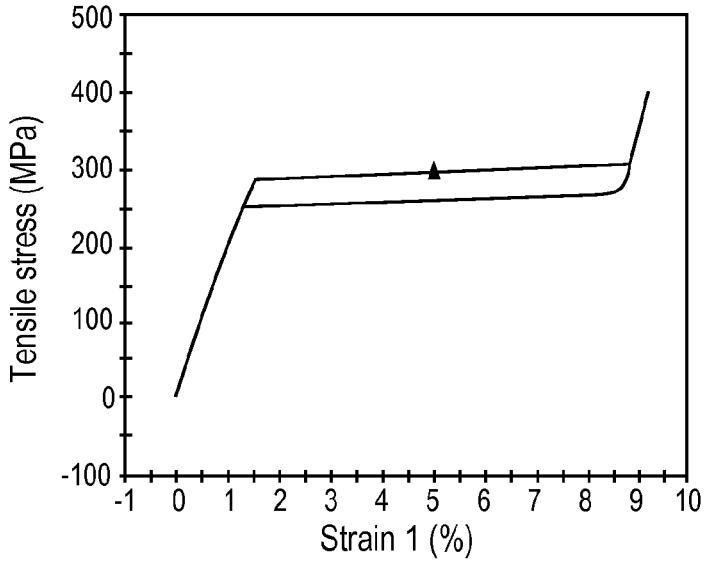
FIG. 1A is a stress-strain-temperature plot for CuAlNi single crystal shape memory alloy. The alloy is a CuAl (14.3%)Ni(4.5%), $A_f$=−40° C.

Described herein are thermally-activated sprinkler valve assemblies. These thermally-activated sprinkler valve assemblies may be configured to meet any appropriate performance specifications, particularly those agreed upon by standard-setting bodies such as Underwriter Laboratories (UL). For example, the thermally-activated sprinkler valve assemblies described herein may meet the UL Standards for Safety for Automatic Sprinklers for Fire Protection Service, US 199 ($10^{th}$ edition, Apr. 8, 1997, revised Dec. 8, 2003). In particular, the thermally-activated sprinkler valves described herein may outperform currently available frangible glass, eutectic, and other shape-memory based sprinkler valves because they may be made particularly vibration-insensitive, stable, and predictable.

In general, the thermally-activated sprinkler valve assemblies described herein include a fluid passageway having an outlet that is valved (over the outlet), and a temperature-sensitive actuator that can be activated to open the valve and allow fluid to flow from the sprinkler. The temperature-sensitive actuator typically includes a frangible bolt and a shape-memory element that is coupled to the bolt. Actuation occurs when the shape-memory element expands at a predetermined temperature to break the bolt.

The fluid passageway of the sprinkler may include a threaded tubular conduit portion which is adapted to be connected to a conduit network of a fire protection system. The conduit includes a fluid passage having an inlet for attachment to a pressurized fluid source, such as a pressurized water source, and an outlet. The fluid passageway may also be connected to a frame portion or body region, preferably made from a metal such as brass, stainless steel, or other durable, non-corroding conventional sprinkler frame material. For example, the frame may extend from the fluid passageway region distally and may have one or more arms. A deflector plate assembly for dispersing water when the sprinkler is active may also be attached. The fluid passageway is valved, and may include a valve plug. The valve communicates with a temperature-sensitive actuator that can be activated to open the otherwise closed valve. In some variations the temperature-sensitive actuator communicates with the valve through a linkage element, also referred to as a linkage, which is configured to oppose the force applied by the water pressure until activation. In these variations, activation of the sprinkler occurs when the actuator displaces the linkage, releasing the valve to open. In some variations, the frangible bolt acts as the linkage element.

The temperature-sensitive actuator (or just actuator) includes a frangible bolt and a shape-memory element that are coupled together so that expansion of the shape-memory element may result in breaking of the frangible bolt. The frangible bolt may also apply a compression stress on the shape-memory element.

A shape-memory element may be made of a single-crystal shape-memory alloy (SMA) that has a very large recoverable strain. For example, the recoverable strain may be more than nine percent. This shape-memory element is compressed and held under load by the frangible bolt. As described in more detail below, the frangible bolt may be notched or otherwise prepared to fracture at a preset stress and strain.

Figure 1B:
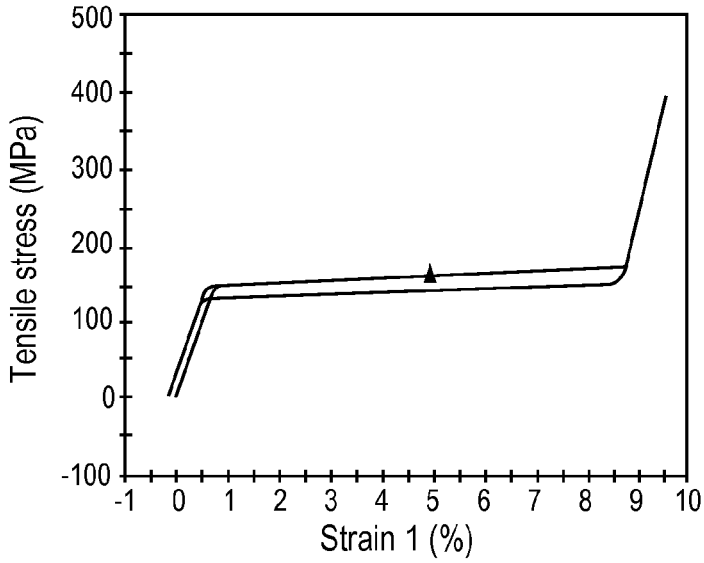
FIG. 1B is a stress-strain curve for CuiAl(14.0%)Ni(4.5%), $A_f$=+15° C.
Figure 2A:
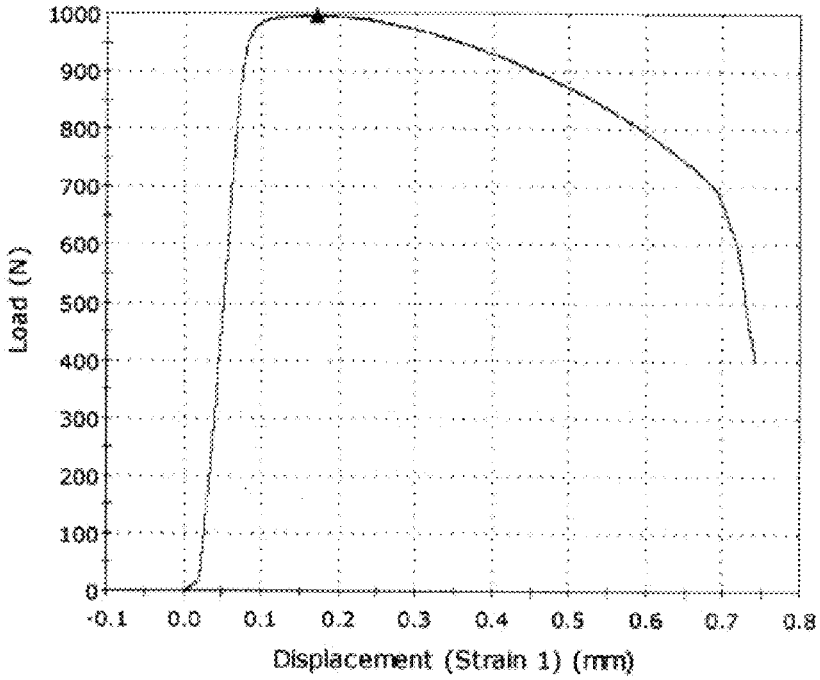
FIG. 2A is a stress-strain plot for a notched steel bolt showing its elongation to failure at the ultimate tensile stress of the steel. Tensile force reaches a maximum at the upper limit of elasticity, and diminishes as elongation continues, terminating in fracture at a fraction of one percent strain.
Figure 2B:
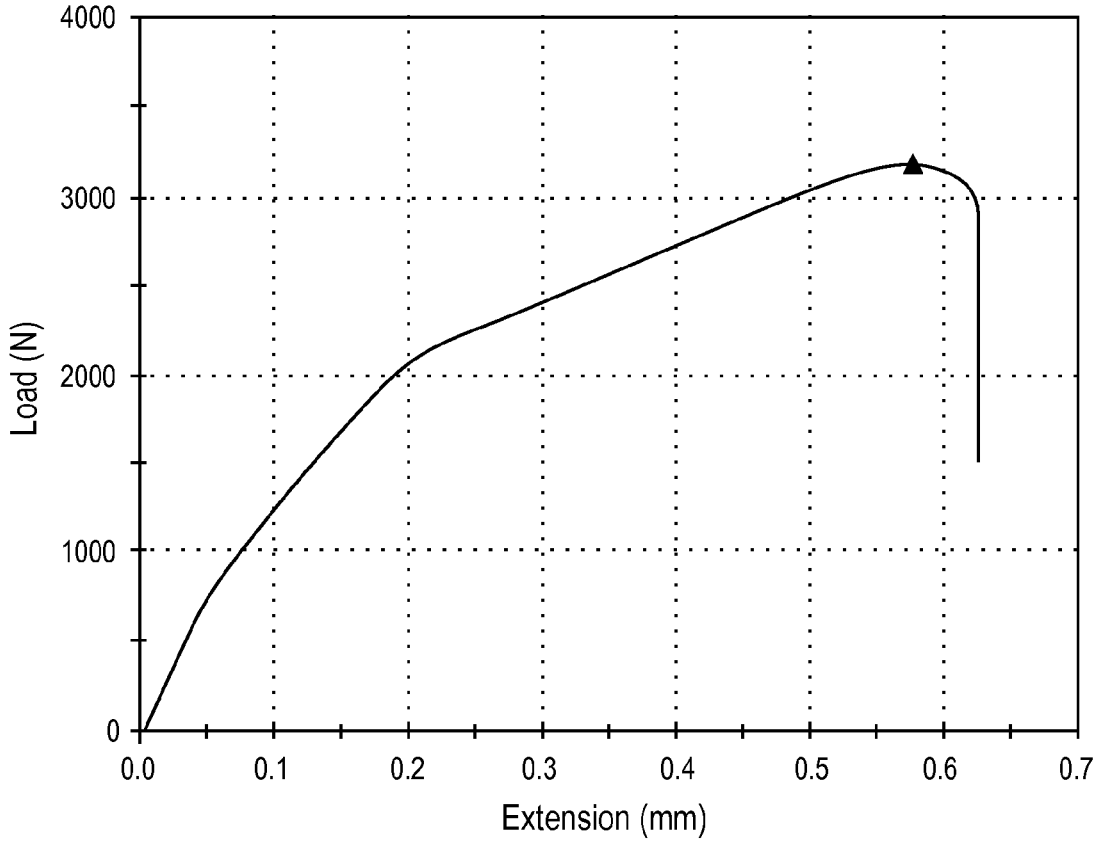
FIG. 2B is a stress-strain plot for a notched titanium bolt, showing the elongation to failure at the ultimate tensile stress. The titanium bolt was a Ti-6Al-4V bolt notched to 0.056. The maximum tensile stress is approximately 1999.4 MPa. A diamond-shape Carbide insert notching tool having 35° angle and 0.015" tip radius was used to form the notch.

Single crystal shape memory alloys, in addition to having uniquely large recoverable strain, have a plateau in their stress-strain relationship that increases with increasing temperature in a highly predictable manner, as illustrated in FIGS. 1A and 1B. By adjusting composition, and by tempering to tune the temperature at which a specified stress (and hence force) is applied by the SMA element, it is possible to precisely match the force exerted by a frangible bolt, and to elongate it to failure. See FIG. 2A, showing the stress/strain relationship for a notched steel bolt, and FIG. 2B showing the stress/strain relationship for a notched titanium bolt.

Thus, a high-tolerance actuator may be made by matching the point on the stress/strain curve from the frangible bolt (the ultimate tensile strength) with the plateau stress of the shape-memory element. Matching these characteristics of the frangible bolt and the shape memory element allows selection of the precise temperature of actuation, which may be specified. Such precise actuators may therefore be manufactured at low cost, because this 'tuning' can be done only once per lot of material.

In assembling the valve, the actuator including the shape-memory element and the frangible bolt may be connected to the valve opposing the fluid pressure so that the force of the fluid pressure is not substantially communicated to the shape-memory element. For example, the SMA element and bolt may be offset from the force of the fluid pressure so that the fluid pressure force is not directly applied to either the bolt or the shape-memory element. This means that the bolt may be pre-loaded to its optimum tension (for the shape-memory element) independent of the force applied by the pressurized liquid. Since the force applied to the shape-memory element is not dependent on the (potentially variable) fluid pressure, the fluid pressure force will not alter the activation temperature for the actuator.

In general, the stress plateau in a CuAlNi (or CuAlMn) single crystal is related to the austenite finish temperature, $A_f$, of the material. The stress plateau is determined by the difference between $A_f$ and the actuation temperature multiplied by a constant (approximately 2.2 Mpa per ° C.). For example, see FIG. 1A-1C. $A_f$ is the temperature at which transformation from martensite (low temperature phase) to austenite is completed at zero stress. $A_f$ is determined primarily by the composition of the ingot from which the crystal is grown. A composition of 81.2 weight percent Cu, 14.3 weight percent Al, and 4.5 weight percent Ni, for example, produces an $A_f$ transition temperature near −40° C.

Figure 1C:
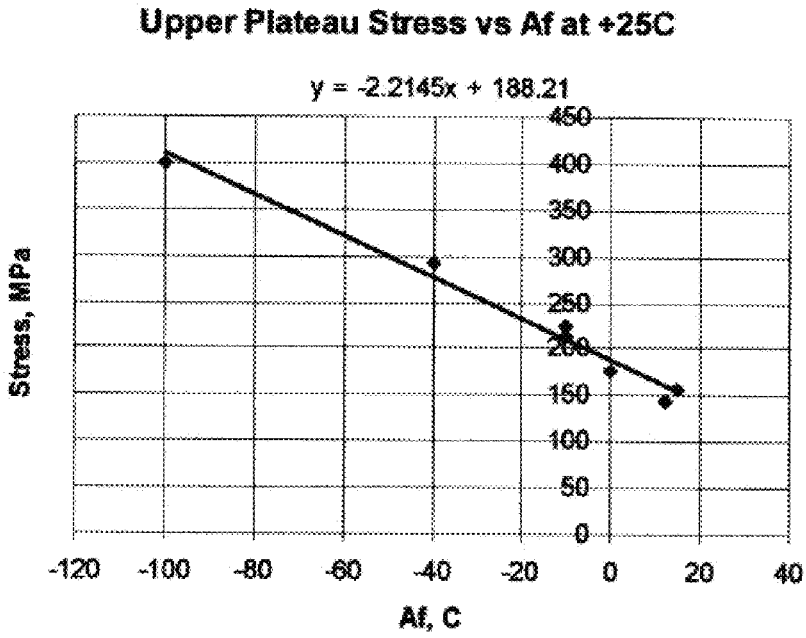
FIG. 1C is a correlation of $A_f$ with composition content of Al. The stress plateau increases 2.2 megapascals for each ° C. increase in ambient temperature.

Slight variations in composition, even of the order of 0.1 percent, can result in a significant variation of $A_f$, as shown in FIG. 1C. Such variations may result from weight measurement inaccuracies, or evaporation of metal from the melt before or during the crystal pulling operation, and so are difficult (if not impossible) to control with the precision necessary to meet sprinkler specifications. Actuation temperatures for sprinkler systems are preferably controlled within plus or minus about 3° C. This limitation may be overcome in the sprinkler valves described herein by tempering the SMA material used.

Figure 10:
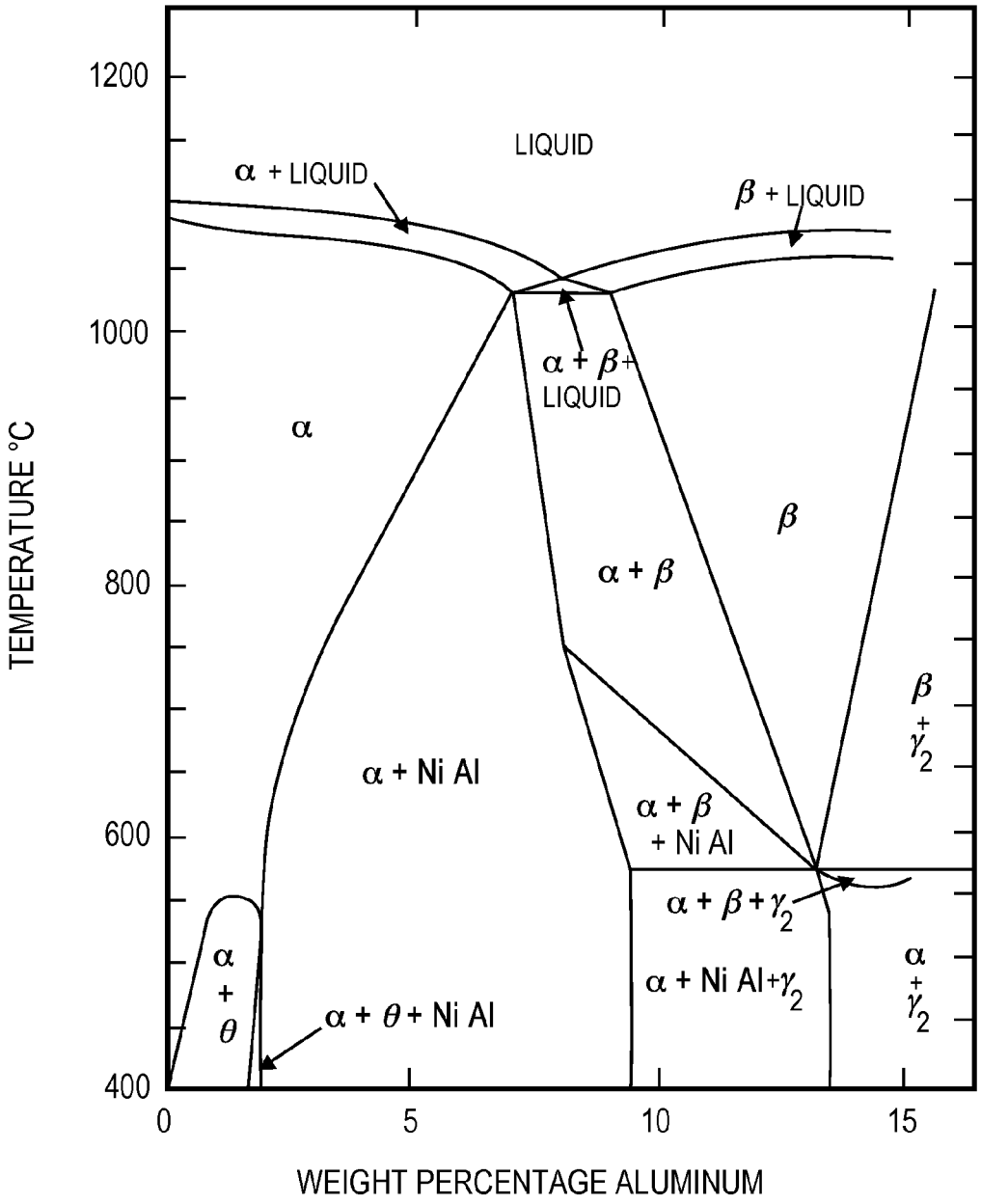
FIG. 10 is a phase diagram for CuAlNi(3%).

At elevated temperatures, Al gradually precipitates as nanocrystals. FIG. 10 shows a phase diagram for the CuAlNi alloy system showing the phases that may exist in molten alloy at various temperatures. Since nanocrystalline Al does not participate in the phase transformation, controlled precipitation of Al is a method of precisely tuning the $A_f$ of the material. Controlled selective precipitation for the purpose of adjusting the actuation temperature of the SMA is a unique form of tempering.

The shape-memory element provides the mechanical energy necessary to actuate the actuators described herein, and actuation occurs by breaking the frangible bolt and releasing the valve. For example, a shape-memory element may be a cylinder of single-crystal, hyperelastic CuAlNi having a transition temperature above room temperature with a stress plateau at about 200 Mpa. Other examples of shape-memory elements that may be used are provided herein, and generally the properties of the shape-memory element are matched to the properties of the bolt. In this first example, the shape-memory element is a cylinder with a cross-section that applies a force of 40 kg at the stress plateau to a bolt that fractures at 40 kg elongation force when elongated more than 3% of its length. The frangible bolt may be secured by a nut that pre-loads the bolt to a tensile 35 kg force (and thus applies an opposing compressive force to the shape memory element). The bolt applies this compressive force to the shape memory element. For example the shape-memory element may be compressed approximately 9 percent of its length while the SMA is in its martensitic state.

Figure 3A:
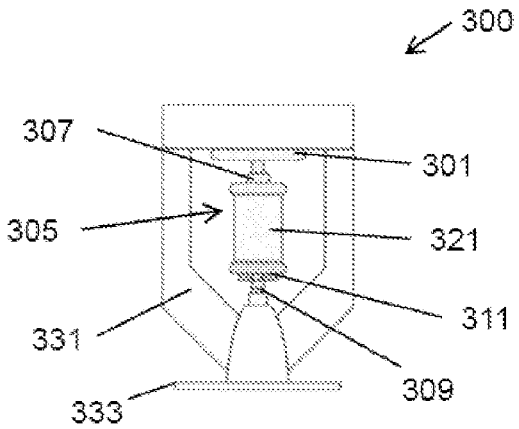
FIG. 3A shows a side view of one variation of a sprinkler including a thermally-activated sprinkler valve assembly.
Figure 3B:
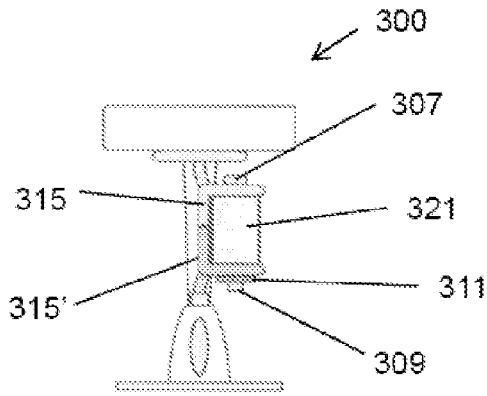
FIG. 3B is a front view of the same sprinkler shown in FIG. 3A.

FIGS. 3A and 3B shows one variation of a sprinkler having a thermally-activated sprinkler valve assembly as described. In this example, the sprinkler 300 includes a temperature-sensitive actuator 305, connected to a linkage 315, 315', which is held in communication with a valve (the outside 301 of which is visible in FIGS. 3A and 3B) and is supported by a frame 331 or body region. A deflector plate 333 is attached to (or integral with) the frame 331. The frame 331 in this example includes two arms.

The temperature-sensitive actuator 305 includes a frangible bolt 309, the bottom of which is visible in FIGS. 3A and 3B, which is secured to (and compresses) a shape-memory element 321 formed as a cylinder. The bolt is secured to linkage 315, 315' and held within the cylinder by a nut 307 on one end, and is also attached to a washer 311 on the opposite end. The linkage is formed by an upper bracket 315 and a lower bracket 315' that are held together between the valve 301 and the frame 331. When the temperature-sensitive actuator is activated by reaching or exceeding the pre-determined activation temperature, the shape-memory element will expand (e.g., greater than 5%, greater than 6%, greater than 7%, greater than 8% or greater than 9% of its compressed length), and break the frangible bolt 309. Breaking the frangible bolt causes the upper and lower brackets of the linkage to separate under the force provided by the source of liquid (e.g., water) pressure, and thereby release the valve opposing the force of the liquid pressure, allowing water to flow out of the valve. The water may strike the deflector plate. After activation, the temperature-sensitive actuator and the linkage may fall way from the rest of the sprinkler.

FIG. 3B shows a partial cut-away view of the sprinkler of FIG. 3A (in which one of the "arms" of the frame 331 have been removed). In FIG. 3B it is apparent that the linkage is formed by an upper 315 and lower 315' bracket that are configured so that the majority of the force of the liquid pressure is opposed by the linkage, and the temperature-sensitive actuator 305 is mounted in parallel to the linkage. Thus, the force exerted by the liquid pressure is not transferred to the frangible bolt via the linkage. The frangible bolt holds the two approximately right-angle-shaped linkage members secure until heat causes the SMA element to expand and fracture the frangible bolt, causing the linkage to collapse and release the fluid pressure. The compressive force on the shape-memory element is predominantly applied by the bolt 309, and the shape-memory element does not receive a substantial amount of the force from the fluid pressure.

In this example, it is significant that the force due to fluid pressure is transferred to the linkage and not to the frangible bolt because the actuator, consisting of the shape-memory element and frangible bolt, can be tuned to actuate at a predetermined temperature (and force) independent of the force exerted by the fluid force. If this were not so, the actual force seen by the frangible bolt may depend on the sum of the (variable) fluid force and the (constant) pre-load force, and the result would be undesirable variation of the actuation temperature.

Figure 4A:
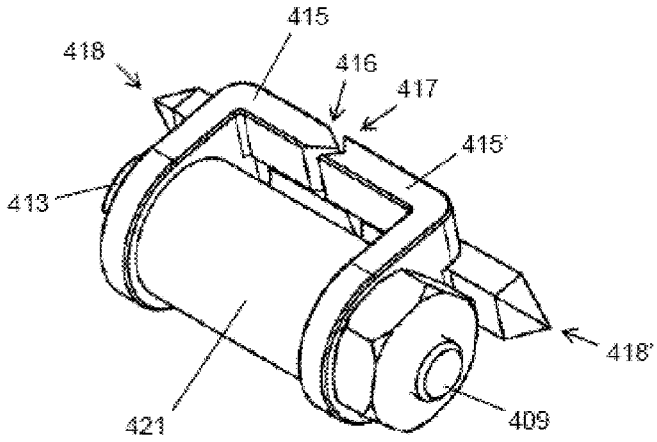
FIG. 4A shows a side perspective view of one variation of a temperature-sensitive actuator coupled to a linkage formed by two brackets.

FIG. 4A shows a perspective view of the temperature-sensitive actuator and linkage similar to that shown in FIGS. 3A and 3B. In this example, the shape-memory element 421 is a cylinder that is compressed by the frangible bolt 409 between two brackets 415, 415' forming a linkage. The two brackets in this example are nearly identical right-angle-shaped members 415, 415' that interconnect. One of the brackets 415 has a pointed (or male) end 416 that mates with concave (or female) end 417 on the other bracket 415'. The opposite ends of the brackets forming the linkage 418, 418' are also configured to releasably mate with the valve and/or the frame 331. In this example, these ends are pointed, but they may be rounded, blunt, or any other appropriate shape. The two brackets may be identical, each having one convex end and one concave end.

Figure 4B:
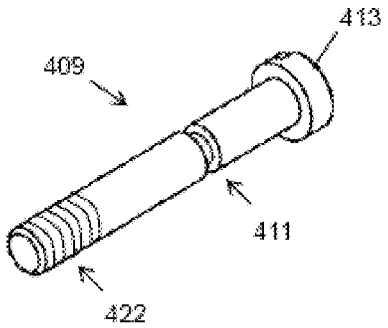
FIG. 4B shows the notched bolt of the actuator of FIG. 4A.
Figure 4C:
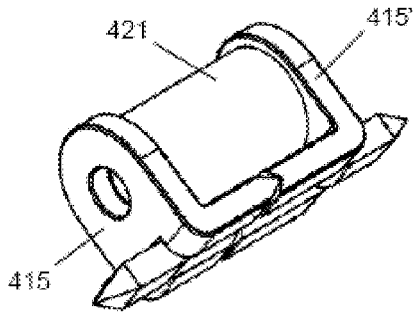
FIG. 4C shows the actuator and the linkage without the notched bolt.
Figure 5A:
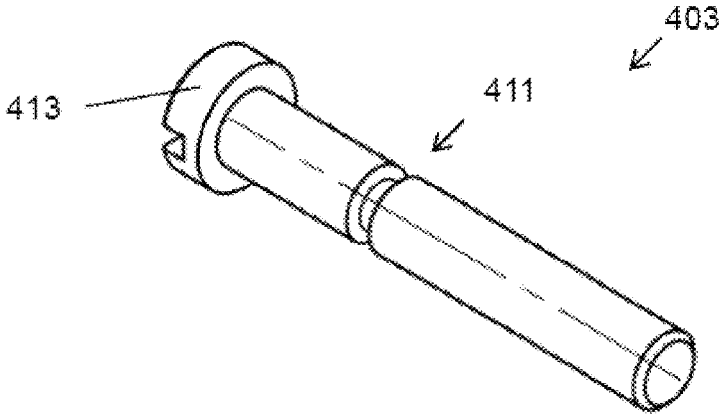
FIG. 5A is a perspective view of one variation of a notched frangible bolt.
Figure 5B:
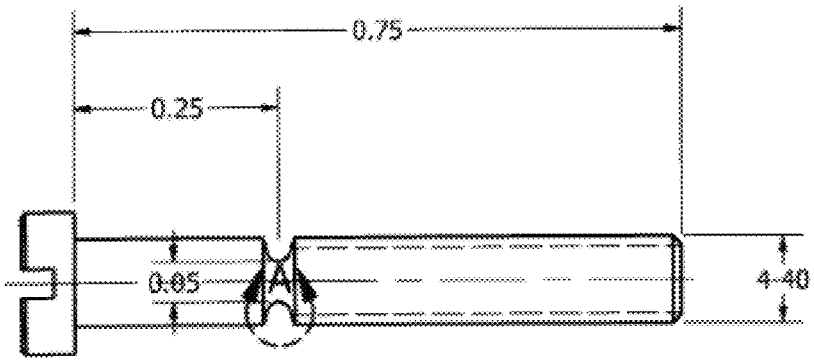
FIG. 5B is a side view of the frangible bolt of FIG. 5A, showing exemplary dimensions (inches).
Figure 5C:
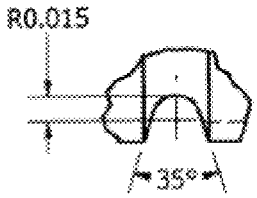
FIG. 5C is a detailed view of the notched region A indicated in FIG. 5B.

FIG. 4B shows the frangible pin from FIG. 4A removed from the temperature-sensitive actuator, and FIG. 4C shows the shape-memory element and linkage with the frangible pin removed. FIGS. 5A-5C also show greater detail of a frangible bolt.

Any appropriate frangible bolt may be used. In general, a frangible bolt is an elongate member. The frangible bolt may be a cylindrical bolt (as shown in FIGS. 4B-5B) including a threaded portion 422. The threads may mate with a nut. The entire bolt may be threaded or just one or more regions may be threaded. In some variations, the thread mates with the linkage. Other bolt shapes (including unthreaded bolts) may also be used. The bolt 409 may include a head region 413 that has a flanged portion extending outward from the elongate length of the bolt. The head region 413 in this example is slotted, but it may be otherwise configured for securing or gripping.

A frangible bolt may also be notched. In FIGS. 4B-5C the notch 411 is shown as an annular cut-out region. FIG. 5C illustrates this region in greater detail. The notch may be formed by any appropriate manner, including removing material from the bolt after it has been formed, or it may be cast as an initial part of the bolt. In some variations the notch does not extend annularly, but may be present on only one side or region of the bolt. Such asymmetric notching may help direct the fracturing of the frangible bolt. The depth of the notch may help set the ultimate tensile strength of the frangible bolt (the stress at which the bolt will fracture), and may therefore help match the bolt to the shape-memory element, as described below. The notch may be located at any position along the length of the bolt, and the location of the notch along the bolt may also help determine the ultimate tensile strength. In some variations the bolt may include only one notch or multiple notches.

The bolt may be made of any appropriate material, particularly metals including alloys. For example, the bolt may be a titanium bolt, such as a Ti6Al4V bolt, a steel (e.g., stainless steel) bolt, or the like.

Figure 6A:
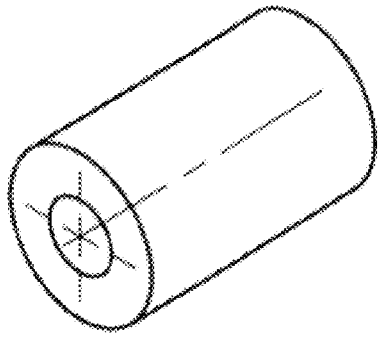
FIG. 6A is a perspective view of one variation of a shape-memory element for an actuator.
Figure 6B:
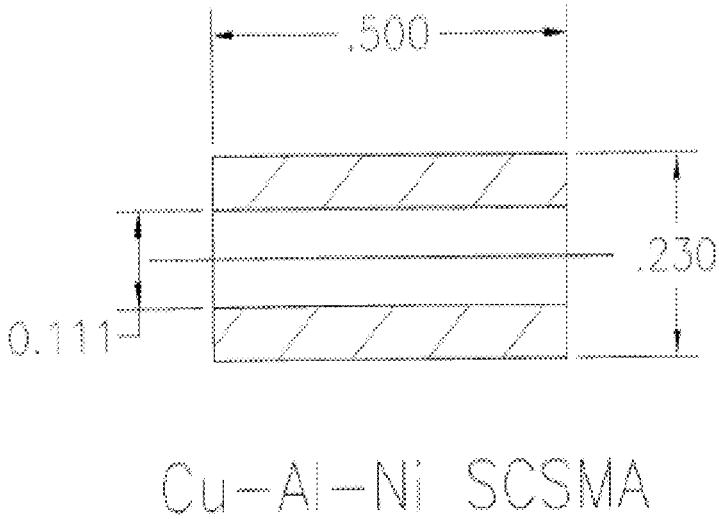
FIG. 6B is a cross-section through the shape-memory element of FIG. 6A, showing exemplary dimensions (inches).
Figure 6C:
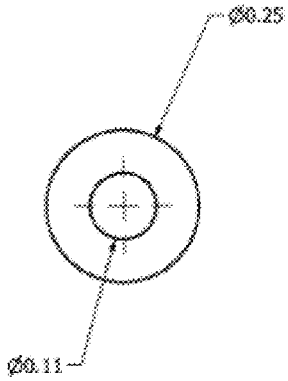
FIG. 6C is a top view of the shape-memory element of FIG. 6A.

FIGS. 6A-6C show one variation of a shape-memory element that may be used as part of a temperature-sensitive actuator, which is configured as a cylinder. FIG. 6A shows a perspective view of this cylindrical shape-memory element, which has a circular cross-sectional profile (shown in FIG. 6C). The shape-memory element has a length that is slightly less than the length of the bolt. The cylindrical shape-memory element in this example is hollow, so that it can surround the frangible bolt.

Different configurations of shape-memory elements may be used. For example, a cylindrical shape-memory element may have a non-circular cross-section (e.g., an elliptical, cross-section, a square cross-section, etc.). The shape-memory element may be configured as a strut that is not hollow and which fastens to the bolt in two or more places. The shape-memory element may be a partial tube (e.g. a c-shaped tube).

The shape-memory element may be made of a single-crystal shape memory alloy, such as a single-crystal CuAlNi alloy or a single-crystal CuAlMn alloy. In particular, the shape-memory element may be made of a shape-memory material capable of elongating up to 7%, 8% or 9% of their length, referred to as "hyperelastic" shape memory alloys. The exact composition (percent composition) of the shape-memory alloy may be modified or pre-determined to help match the stress plateau characteristics of the shape-memory element with the stress profile (e.g., ultimate tensile strength) of the frangible bolt.

By matching the peak strength of the frangible bolt to the stress plateau of the shape-memory element, assured separation of the bolt is achieved in a narrow temperature range as the shape-memory element elongates much more than necessary to cause the frangible bolt to fracture.

Thus, the temperature-sensitive actuator may include a frangible bolt whose peak strength is matched to the stress plateau of the shape-memory element. For example, the temperature sensitive actuator may be made by first selecting a desired actuation temperature $A_t$. For example, the actuation temperature, $A_t$, may be selected from within the range of about −200 to +200° C. An optimum stress plateau level ($S_p$) may then be chosen. For example, $S_p$ may be between 50 and 600 Mpa. The relationship between the stress plateau level and the activation temperature may be described by the formula:

$$S_p=2.3(A_t-A_f)$$

Where $A_f$ is the austenite finish temperature of the shape-memory element, as described above. By choosing a cross-sectional area $X_c$ of the shape-memory element that applies force to the frangible bolt, the force exerted by the shape-memory element $F_a$ can then be determined from the relationship:

$$F_a=S_p*X_c$$

The ultimate strength of the frangible bolt (e.g., a notched frangible bolt) may then be matched to equal this force ($F_a$) and the elongation to failure=$E_f$, using a suitable margin of safety to determine the length of the shape-memory element $L_a$ such that, at the appropriate percent elongation (e.g., 5%, 6%, 7%, 8%, 9% elongation), the actuator will break the bolt while maintaining the margin of safety. These calculations should also take into account the compliance of other elements in the joint.

Based on this determination, the ingot composition that will produce single crystal material with $A_f$ can be chosen in order to make the shape-memory actuator. For example, if the shape-memory actuator is a cylinder, then a cylinder with a cross-section $X_c$, length $L_a$, and an opening large enough to accommodate the bolt may be fabricated.

The shape-memory element can then be compressed. For example, a press can be used to compress the actuator to its 9 percent limit, and to maintain this shortened length by keeping the actuator well below $A_f$.

To complete assembly of the temperature-sensitive actuator, the bolt, shape-memory element, and any other elements in the joint, such as a nut, can then be assembled. The nut can be tightened so that there is no slack in the joint. Finally, the remainder of the sprinkler valve body can be installed, including the linkage.

Any appropriate linkage may be used to connect the actuator to the sprinkler. In particular, it may be preferable to use a linkage that opposes the force of fluid (e.g., water pressure) when the device is connected to a source of fluid pressure and the valve is closed. In particular, it may be preferable to use linkages that do not transfer a substantial portion (if any) of the fluid pressure to the shape-memory element when the actuator is installed with the other components of the sprinkler.

A linkage may connect or couple with the valve that opposes the fluid pressure from a source of pressurized fluid that is connected to the fluid passageway of the device. For example, the linkage may abut or contact a portion of a valve (e.g., a valve plug), to prevent the fluid pressure from opening the valve. The linkage may also be connected or coupled to the body of the fluid passageway (or another portion of the sprinkler body that is connected to the body of the fluid passageway). In the example shown in FIG. 3A, the linkage is coupled to the frame 331. In some variations, the linkage is configured to readily un-couple from the valve (and/or frame or sprinkler body) when the actuator triggers upon breaking of the frangible bolt. In some variations, the frangible bolt may act as the linkage. For example, one end of the frangible bolt may be coupled to the valve, and the other end may be functionally coupled to a frame connected to the sprinkler body.

Figure 7A:
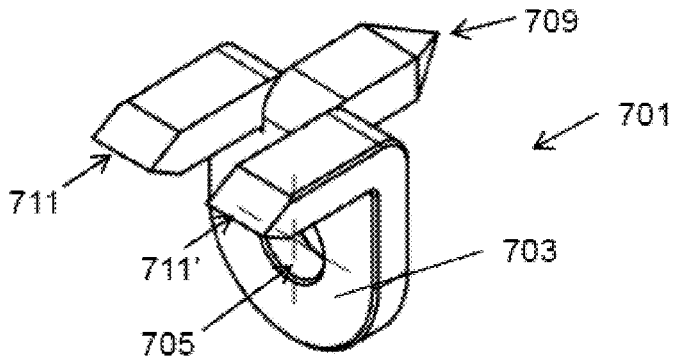
FIG. 7A is a perspective view of a first linkage bracket that may form a linkage.
Figure 7B:
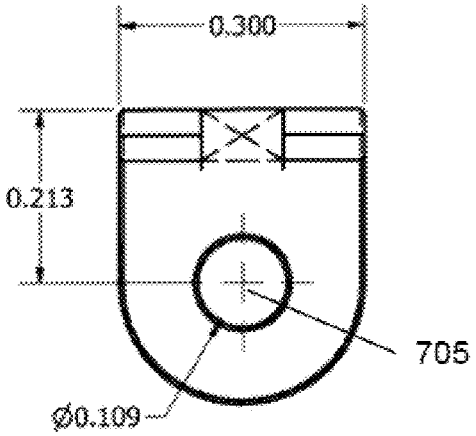
FIG. 7B is a first side view of the linkage bracket of FIG. 7A, with exemplary dimensions (inches)
Figure 7C:
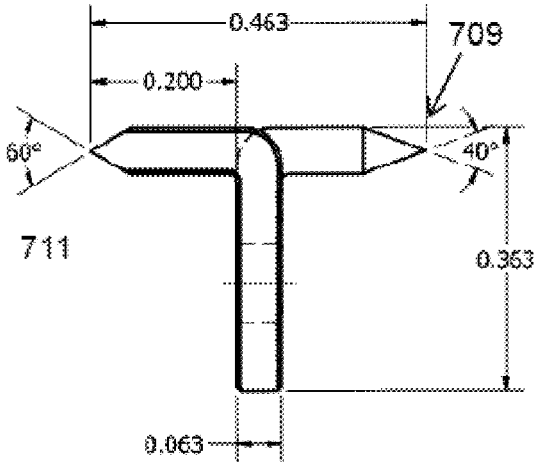
FIG. 7C is another side view of the linkage bracket.
Figure 7D:
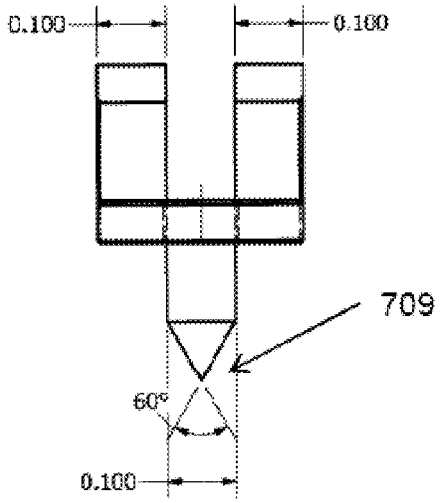
FIG. 7D is a top view of the linkage bracket of FIG. 7A.
Figure 8A:
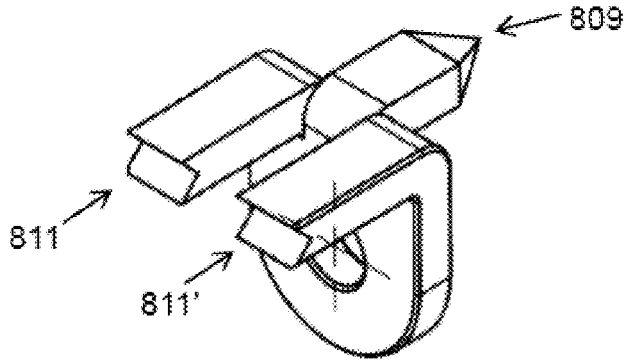
FIG. 8A is a perspective view of a second linkage bracket that may form a linkage.
Figure 8B:
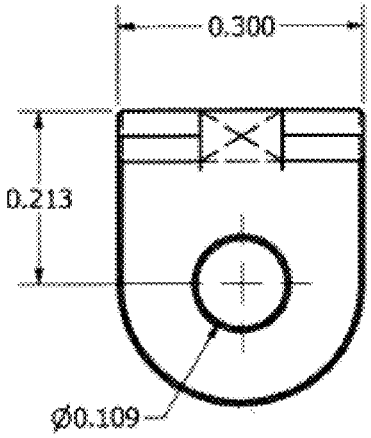
FIG. 8B is a first side view of the linkage bracket of FIG. 8A, with exemplary dimensions (inches)
Figure 8C:
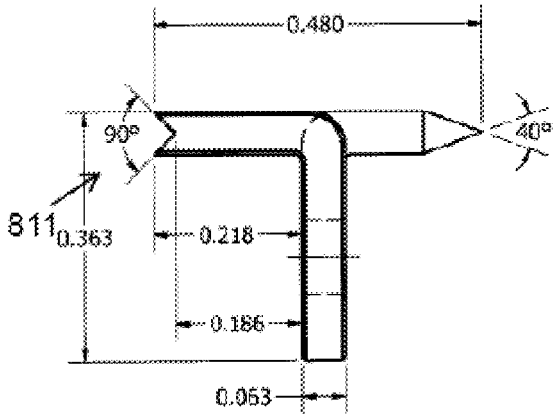
FIG. 8C is another side view of the linkage bracket.
Figure 8D:
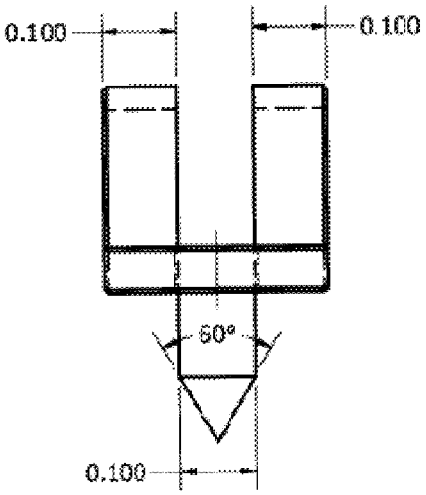
FIG. 8D is a top view of the linkage bracket of FIG. 8A.

A two-piece linkage, such as that shown in FIGS. 3A-3B, 4A and 4C may be particularly useful. In this example, the linkage includes an upper (or first) linkage bracket and a lower (or second) linkage bracket. FIGS. 7A-7D illustrate one variation of an upper linkage. FIG. 7A shows a perspective view of an upper linkage bracket 701 having a generally "T" shape. The bracket may be formed from a single (flat) piece of metal that is cut and bent to form the shape illustrated. The region of the bracket configured to hold the actuator 703 is formed by the base of the "T" shape, and may include a hole or passage 705 through which the actuator (e.g., the frangible bolt portion of the actuator) may pass. The top of the "T" shape in this linkage forms three prongs. One of the prongs 709 is configured to communicate with the valve, and the other two prongs 711 are configured to communicate with (e.g., mate with) prongs extending from the lower linkage. Although in this example three prongs are shown, two prongs may be used. Also, the orientation of the prongs may be different; for example, the two prongs 711 may be configured to couple with the valve and the single prong may be configured to couple with the other linkage. FIG. 7B shows a top view, and FIGS. 7C and 7D show sides view of the upper bracket 701.

FIGS. 8A-8D show an example of a lower bracket linkage that may be used with the upper bracket linkage of FIGS. 7A-7D to couple with an actuator and the valve of a fluid passageway. The lower bracket is very similar to the upper bracket, except that the two prongs that mate with the upper bracket prongs 811, 811' are shaped to receive the upper bracket prongs.

Figure 9:
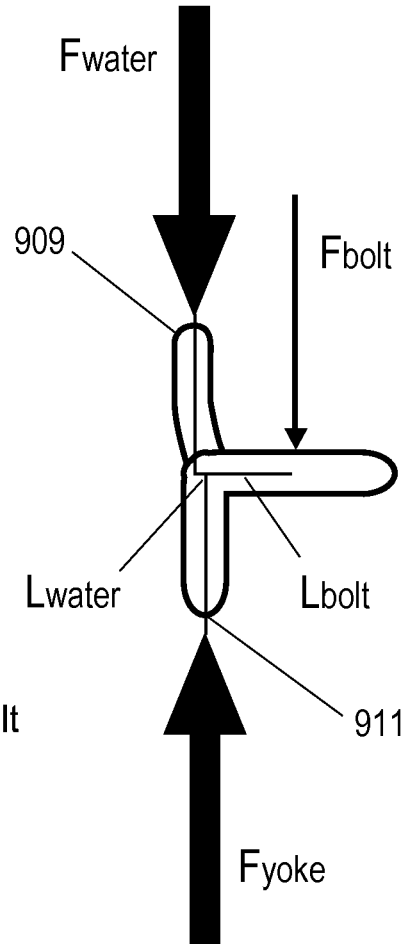
FIG. 9 illustrates forces acting on a portion of a linkage, and illustrates how a linkage may oppose the force of water pressure and impart direction to the actuator after activation.

The linkage may be configured so that the activation of the temperature-sensitive actuator causes a predictable release. For example, FIG. 9 illustrates the cross-section of another variation of an upper bracket that is configured so that activation of the actuator, and breaking of the frangible bolt, causes a predictable release. Although FIG. 9 shows only an upper bracket, a second, nearly identical lower bracket may have a similar design.

The upper bracket linkage shown in FIG. 9 is similar in orientation to the upper bracket linkage shown in FIG. 7C, only rotated 90 degrees counterclockwise. In this orientation, the first prong 909 of the bracket is configured to communication with the valve and oppose the force of the fluid pressure (indicated by $F_{water}$). The opposite prong 911 or prongs are configured to mate with a lower bracket linkage which in turn mates with the frame (also referred to as a "yoke") connected to the body of the fluid passageway. Thus, these prong(s) 911 receive the counter force, $F_{yoke}$, to help balance the $F_{water}$ and thereby keep the valve closed while the linkage is intact. In addition to the forces balance the fluid pressure, the bolt of the temperature-sensitive actuator also acts on the brackets by providing a force $F_{bolt}$ that is also opposed and balanced by the counterforce from the frame, $F_{yoke}$. At equilibrium, the force of the fluid pressure $F_{water}$ times the length of the lever arm $L_{water}$ (the length seen by the $F_{water}$ in relation to the opposing force $F_{yoke}$) is balanced by the force of the bolt, $F_{bolt}$, times the lever arm $L_{bolt}$, preventing the bracket from rotating and coming uncoupled. In the example of FIG. 9, the ratio between the lengths of the lever arms and the forces applied by the bolt and the fluid (water) on the bracket are generally balanced as a 1:8 ratio, but any appropriate ratio may be used. During activation, the force applied to the bracket will unbalance as the bolt breaks, resulting in the rotation and uncoupling of the bracket, removing the linkage and releasing the valve.

A thermally-activated sprinkler valve assembly as illustrated may be made by any appropriate method, as mentioned above. In general, this method of making a thermally-activated sprinkler valve may include first tuning a shape-memory element to exert a pre-determined force at a pre-determined temperature. In some variations, tuning involves selecting the activation temperature ($A_t$), and setting the austenite finish temperature ($A_f$) based on that temperature. This may be accomplished in part by tempering. For example, a shape-memory element comprising single-crystal shape memory alloy can be tempered by heat treating and controlling the partial precipitation of Al from the single-crystal material. Tweaking the concentration of Al will adjust the $A_f$.

Tuning may include matching the plateau stress of the shape-memory element to the ultimate tensile stress (the breaking point) of the frangible bolt. Stress profile may be examined periodically to determine the plateau stress (as shown in FIGS. 1A and 1B), or it may be calculated. The shape-memory material may also be tuned by otherwise manipulating the composition of the shape-memory material (e.g., doping, etc.). The ultimate tensile strength of the bolt may also (or alternatively) be set based on the shape-memory element (e.g., the plateau stress). For example, the bolt shape and size may be selected to set the ultimate tensile strength. Thus, the bolt may be notched or otherwise treated to set the approximate ultimate tensile strength of the bolt.

The temperature-sensitive actuator may then be formed by coupling the frangible bolt to the shape-memory element so that the shape-memory element is compressed by the frangible bolt. Finally, the actuator may be attached to the rest of the thermally-activated sprinkler by coupling the actuator to a linkage, wherein the linkage is configured to couple with the valve of a fluid passageway having a valved outlet to oppose fluid pressure and maintain the valve closed.

The assembled sprinkler may then be attached to a fluid source.

EXAMPLES

Temperature-sensitive actuators were made by cutting shape-memory elements with an abrasive wheel from Cu-14.0Al-4.5Ni tubing (OD=0.235", ID=0.115"). No subsequent machining was performed. The shape-memory elements were approximately 0.451" to 0.478" long. The shape-memory elements were compressed and constrained with the brass 4-40 button headed notched screws and brass nuts. Notch size was 0.070"+/−0.001". Assemblies were individually tested by immersion in hot water, the temperature of which was monitored with alkaline thermometer. The average actuation temperature was 49.375° C. (standard deviation of 1.96).

In another example, cylinders of shape-memory material were machined from 0.25" diameter Cu-14.0Al-4.5Ni (OD=0.23"; ID=0.11"; L=0.483"). Machined cylinders were compressed to L=0.450" and constrained with brass 4-40 button headed notched screws and brass nuts. Notch size is 0.070"+/−0.001". On average, the devices actuated between 45-46° C. Afterwards, the cylinders were quenched from 950 C into salt water, compressed and constrained again, and actuated at an average temperature of 46.2° C. (standard deviation of 2.20). These shape-memory cylinders were compressed using frangible bolts made of 4-40 SS, having a notch of 0.070". These actuated at approximately 62° C. (screw strength −2550N).

In yet another example, shape-memory elements were machined from 0.25" diameter Cu-13.9Al-4.5Ni rod (OD=0.23"; ID=0.11"; L=0.49"). These cylinders were quenched from 950° C. into salt water, compressed and constrained. In this example, lowering the Al content by 0.1% resulted in increase of actuation temperature by ~15 C.

Figure 11:
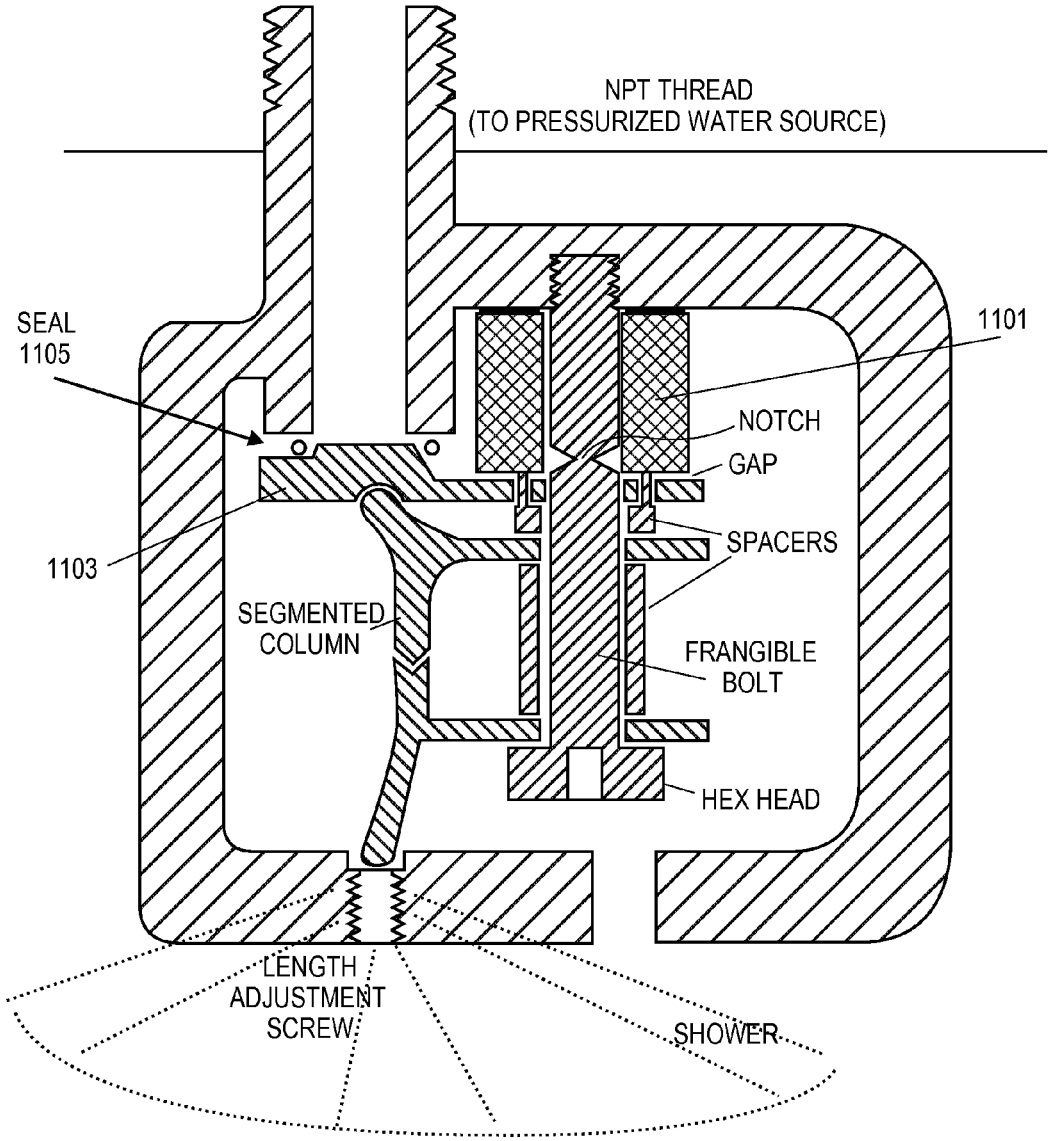
FIG. 11 is a cross-sectional view through one variation of a sprinkler valve with active actuation.

FIG. 11 illustrates another variation of a sprinkler valve, including a sprinkler valve having an active actuation. As described above, the actuator may include a shape-memory element 1101 that extends or expands when activated by a thermal (temperature) change. In general, the shape-memory element of the actuator may be connected or coupled to the poppet 1103 of the valve, as illustrated in FIG. 11. A 'poppet' 1103 is a cover, door, or similar such element on the valve that otherwise prevents it from opening. For example, a poppet may be part of a valve that prevents flow when it closes against a seat 1105 and allows flow when it moves away from the seat.

The shape-memory element may exert a large force for a significant distance, and may therefore help open the poppet of a sprinker, even if the poppet is otherwise stuck, jammed, or difficult to open. In FIG. 11, the poppet is held in place by the segmented column, as described above. The two pieces of the segmented column are secured by the frangible bolt. As the SMA actuator elongates due to the temperature-induced phase change, the frangible bolt fractures at the notch. The segmented column buckles and falls away, removing the poppet detent. The SMA actuator continues to elongate, eventually closing the gap and exerting its full force on the poppet to assure its release.

Other arrangements in which the shape-memory element actively opens the valve are also contemplated. For example, a poppet-less valve may also be included, in which the valve is actively opened by the shape-memory element even without connecting to a discrete poppet. In some variations, the actuator is configured so that the device does not include a frangible bolt, but merely actively actuates the valve. In other variations, the actuator laterally removes a cover or valve restrictor.

Although the devices described herein are configured as sprinkler valves, other configurations may also be used with the temperature-sensitive actuators described. For example, a temperature-sensitive actuator may be used as part of a release valve for pressurized fluids including gasses. While the methods and devices have been described in some detail here by way of illustration and example, such illustration and example is for purposes of clarity of understanding only. It will be readily apparent to those of ordinary skill in the art in light of the teachings herein that certain changes and modifications may be made thereto without departing from the spirit and scope of the invention.

What is claimed is:

1. A thermally-activated sprinkler valve assembly comprising:

a fluid passageway having a valved outlet and configured to connect to a source of pressurized fluid;

a segmented column that is coupled to the valved outlet and configured to oppose the force of pressurized fluid and thereby maintain the valve closed; and a temperature-sensitive actuator coupled to the segmented column, wherein the temperature-sensitive actuator comprises:

a frangible bolt; and a shape-memory element capable of elongating as much as eight percent at a pre-determined stress and temperature, wherein a length of the frangible bolt applies compressive force to the shape-memory element, further wherein the shape-memory element communicates with the valve and is configured to apply force to open the valve.

2. The valve assembly of claim 1, wherein the frangible bolt is notched.

3. The valve assembly of claim 1, wherein the shape-memory element is a single-crystal CuAlNi alloy or a single-crystal CuAlMn alloy.

4. The valve assembly of claim 1, wherein the shape-memory element is a tempered single-crystal shape memory alloy.

5. The valve assembly of claim 1, wherein the shape-memory element comprises a cylinder at least partially surrounding the frangible bolt.

6. The valved assembly of claim 1, wherein temperature-sensitive actuator is configured so that force from the pressurized fluid is not substantially transmitted to the shape-memory element.

7. The valve assembly of claim 1, wherein the plateau stress of the shape-memory element is approximately the same as the ultimate tensile stress of the bolt.

8. A method of activating a thermally-activated sprinkler valve assembly comprising:

applying heat to activate an actuator, wherein the actuator comprises a shape-memory element comprising a single-crystal shape memory alloy, a frangible bolt, and a linkage, wherein the linkage is configured to couple with the valve of a fluid passageway having a valved outlet to oppose fluid pressure and maintain the valve closed;

expanding the shape-memory element to break the frangible bolt to release the linkage from the valve and to apply force to open the valve.

* * * * *